US012004652B2

(12) United States Patent
Cui

(10) Patent No.: US 12,004,652 B2
(45) Date of Patent: Jun. 11, 2024

(54) JOINT DEVICE OF FOLDING BED

(71) Applicant: Shenzhen Bosaidong Technology Co., Ltd., Guangdong (CN)

(72) Inventor: Tianshi Cui, Guangdong (CN)

(73) Assignee: Shenzhen Bosaidong Technology Co., Ltd., Shenzhen (CN)

( * ) Notice: Subject to any disclaimer, the term of this patent is extended or adjusted under 35 U.S.C. 154(b) by 240 days.

(21) Appl. No.: 17/726,528

(22) Filed: Apr. 21, 2022

(65) Prior Publication Data

US 2023/0225519 A1 Jul. 20, 2023

(30) Foreign Application Priority Data

Jan. 19, 2022 (CN) ..... 202220145196.3

(51) Int. Cl.
*A47C 19/12* (2006.01)

(52) U.S. Cl.
CPC ..... *A47C 19/12* (2013.01)

(58) Field of Classification Search
CPC ..... A47C 19/12; A47C 19/128; Y10T 403/60; Y10T 403/602
USPC ..... 5/282.1
See application file for complete search history.

(56) References Cited

U.S. PATENT DOCUMENTS 1,344,588 A * 6/1920 Kozik ..... A61G 7/052 5/512
1,546,332 A * 7/1925 Walters ..... A61G 7/05 403/385
5,161,268 A * 11/1992 Harrow ..... A47C 19/04 403/393
5,287,869 A * 2/1994 Wu ..... A45B 19/04 135/25.4
5,871,227 A * 2/1999 Huang ..... B62B 7/08 280/658
6,814,098 B1 * 11/2004 Marocchini ..... F16B 3/04 137/315.27
2004/0128760 A1 * 7/2004 Schatz ..... A61G 7/0509 5/288
2010/0109395 A1 * 5/2010 Ruthinowski ..... F16F 7/09 267/140.13
2011/0271516 A1 * 11/2011 Slaton ..... G10G 7/005 403/328
2012/0020726 A1 * 1/2012 Jan ..... F16B 5/0642 403/330

(Continued)

*Primary Examiner* — Justin C Mikowski
*Assistant Examiner* — Luke Hall

(57) ABSTRACT

Disclosed is a joint device of a folding bed, which includes: a first connecting arm for connecting a supporting leg of the folding bed, with a through-hole provided thereon, a second connecting arm for connecting a frame of the folding bed, the second connecting arm being connected on an upper end part of the first connecting arm through a rotating shaft, and a connection locking mechanism including two pressing pieces arranged respectively on each side of the second connecting arm, each of the pressing pieces being connected with a hook, and the two pressing pieces being slidable toward or away from each other through springs, so that the hook passes through the second connecting arm and is hooked to or detached from the through-hole, thereby allowing the second connecting arm and the first connecting arm to be locked or unlocked relatively to each other.

7 Claims, 5 Drawing Sheets

(56) References Cited

U.S. PATENT DOCUMENTS

2015/0360348 A1* 12/2015 Noniewicz ..... B25B 5/003
403/326
2020/0359780 A1* 11/2020 Nye ..... A47B 3/087

* cited by examiner

JOINT DEVICE OF FOLDING BED

CROSS-REFERENCE TO RELATED APPLICATION

The present application claims priority from Chinese patent application No. 202220145196.3 filed on Jan. 19, 2022. The entire disclosure of the application is incorporated herein by reference in its entirety.

FIELD OF TECHNOLOGY

The present disclosure relates to the technical field of folding beds, in particular to a joint device of a folding bed.

BACKGROUND TECHNOLOGY

Folding bed frame is a simple frame that can be folded and expanded by various folding methods, which is convenient and easy to store. Existing joints of the folding bed frames have a rotatable hinge structure, that is, the supporting legs are hinged with the frame used for placing the bed sheet. The hinge pin may loosen after repeating uses, and the folding bed will be unstable when expanded, which may cause the user to get injured and affect the service life of the folding bed.

SUMMARY

An objective of the present disclosure is to provide a joint device of a folding bed which may improve user experience and durability of the folding bed.

In order to solve the above-mentioned problem, the present disclosure provides a joint device of a folding bed, which includes:

- a first connecting arm for connecting a supporting leg of the folding bed, and a through-hole being provided on the first connecting arm;
- a second connecting arm for connecting a frame of the folding bed, the second connecting arm being arranged on an upper end part of the first connecting arm, and being connected with the first connecting arm through a rotating shaft; and
- a connection locking mechanism including two pressing pieces arranged respectively on each side of the second connecting arm, each of the pressing pieces being connected with a hook, and the two pressing pieces being slidable toward or away from each other through springs, so that the hook passes through the second connecting arm and is hooked to or detached from the through-hole, the second connecting arm being locked with the first connecting arm when the folding bed is expanded, and the second connecting arm being rotatable around the first connecting arm when the folding bed is stored.

Further, the number of the springs is two, and the connection locking mechanism further includes a connecting plate mounted on the first connecting arm, the connecting plate is located between the two pressing pieces, and each of the springs is respectively positioned between each of the two pressing pieces and the connecting plate, so that the two pressing pieces are slidable toward or away from each other under a pressing force or an elastic force of the springs.

Further, each of the two pressing pieces is connected with two hooks, the two hooks are arranged side by side in an up-down direction and located in the through-hole, each of the two hooks on one of the two pressing pieces and each of the two hooks on the other one of the two pressing pieces are alternatively arranged next to each other and overlap each other.

Further, each one of the pressing pieces is provided with an abutting plate, the abutting plate is connected between the hooks of the each one of the two pressing pieces, and two ends of the springs are respectively abutted on the abutting plate and the connecting plate.

Further, the first connecting arm is provided with two through-holes, the through-holes are arranged along the up-down direction, and the hooks arranged along the up-down direction on each one of the two pressing pieces are respectively located in one of the through-holes.

Further, the connecting plate includes a first vertical plate, a horizontal plate bent and extended outward from one end of the first vertical plate, and a second vertical plate bent and extended downward from the horizontal plate, two ends of one of the springs are respectively abutted against one of the pressing pieces and the second vertical plate, and two ends of the other one of the springs are respectively abutted against the other one of the pressing pieces and the first vertical plate.

Further, one end of the second connecting arm is provided with an arc-shaped groove matching the frame of the folding bed, so as to be clamped to the frame of the folding bed and be rotatable around the frame.

Compared with the prior art, the pressing pieces of the connection locking mechanism in the present disclosure are slidable toward or away from each other through the springs, such the hooks pass through the second connecting arm and are hooked to or detached from the through-hole, and the second connecting arm being locked with the first connecting arm when the folding bed is expanded, and the second connecting arm being rotatable around the first connecting arm when the folding bed is stored. That is, when the two pressing pieces are pressed by the user, the springs are compressed and the hooks are detached from the through-holes under the pressing force, the second connecting arm and the first connecting arm are unlocked such that the folding bed can be stored; when expanding, the pressing pieces are pressed to force the hooks to move toward each other and enter into the through-holes, and then the hooks are hooked into the through-holes under the elastic force of the springs as the pressing pieces are released by the user, the second connecting arm that is connected to the frame on which the bed sheet is placed is locked with the first connecting arm, so that the folding bed is more stable when expanded, thereby improving user experience and durability of the folding bed.

DETAILED DESCRIPTION OF THE EMBODIMENTS

Figure 1:
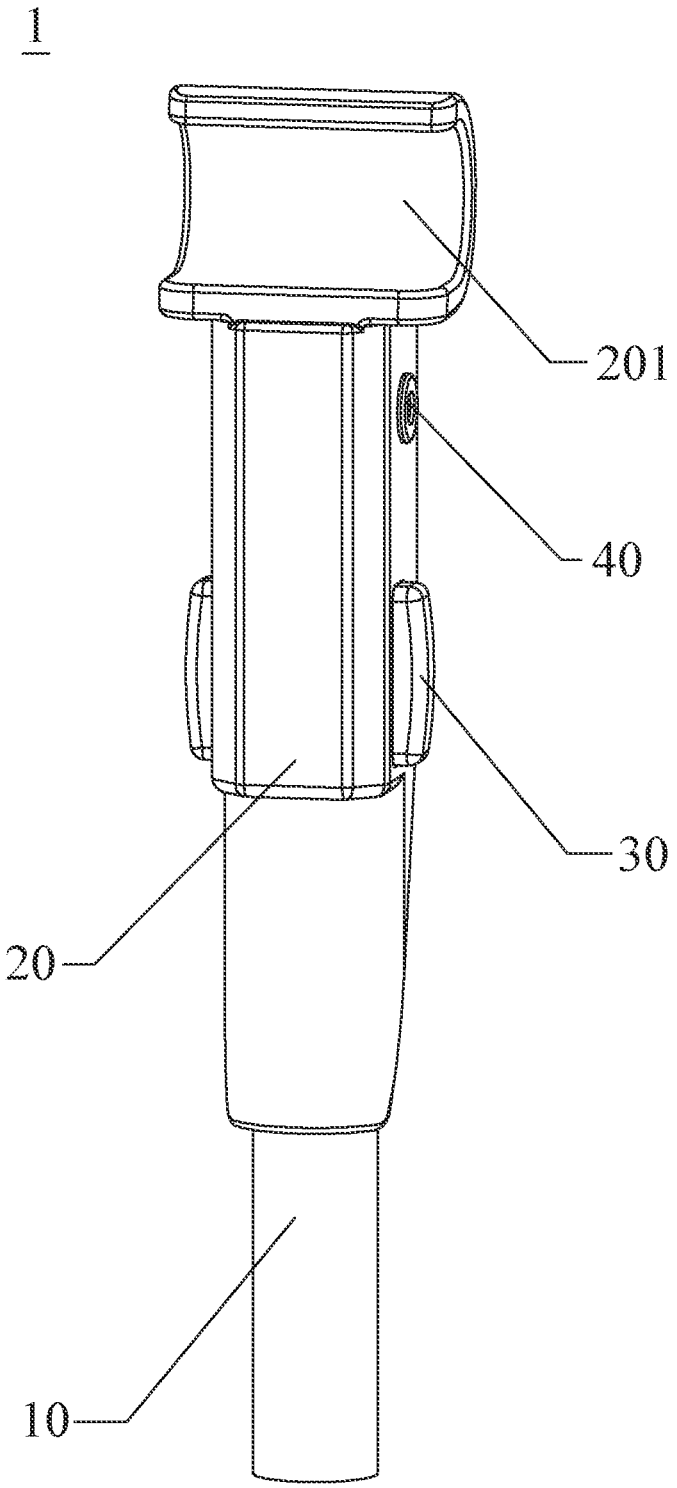
FIG. 1 is a structural view of a joint device of a folding bed according to an embodiment of the present disclosure.

The present disclosure will be further described in conjunction with the accompanying drawings and detailed embodiments, in order to make those skilled in the art more clearly understand the purpose, technical solutions and advantages of the present disclosure.

Referring to FIGS. 1 to 5, which show an embodiment of a joint device of a folding bed 1 provided by the present disclosure, the joint device of a folding bed 1 includes a first connecting arm 10, a second connecting arm 20, and a connection locking mechanism 30 for connecting the first connecting arm 10 and the second connecting arm 20. The first connecting arm 10 is used for connecting a supporting foot 3 of the folding bed 100, and a through-hole 101 is provided on the first connecting arm 10. The second connecting arm 20 is used for connecting a frame 2 of the folding bed 100, and the second connecting arm 20 is arranged on an upper end part of the first connecting arm 10 and is connected with the first connecting arm 10 through a rotating shaft 40. Preferably, in this embodiment, one end of the second connecting arm 20 is provided with an arc-shaped groove 201 matching the frame 2 of the folding bed 100, so as to be clamped on the frame 2 of the folding bed 100 and rotatable around the frame 2 to store and expand the folding bed 100. The connection locking mechanism 30 includes two pressing pieces 301 arranged respectively on each side of the second connecting arm 20, each of the pressing pieces 301 is connected with a hook 302, the two pressing pieces 301 are slidable toward or away from each other through springs 303, so that the hook 302 passes through the second connecting arm 20 and is hooked to or detached from the through-hole 101, and the second connecting arm 20 is locked with the first connecting arm 10 when the folding bed 100 is expanded, and the second connecting arm 20 is rotatable around the first connecting arm 10 when the folding bed 100 is stored. Based on the above design of the joint device of a folding bed 1, the second connecting arm 20 is locked with the first connecting arm 10 when the folding bed 100 is expanded, and the second connecting arm 20 is rotatable around the first connecting arm 10 when the folding bed 100 is stored. That is, when the two pressing pieces 301 are pressed by the user, the springs 303 are compressed and the hooks 302 are detached from the through-holes 101 under the pressing force, the second connecting arm 20 and the first connecting arm 10 are unlocked such that the folding bed 100 can be stored; when expanding, the pressing pieces 301 are pressed to force the hooks 302 to move toward each other and enter into the through-holes 101, and then the hooks 302 are hooked into the through-holes 101 under the elastic force of the springs 303 as the pressing pieces 301 are released by the user, the second connecting arm 20 that is connected to the frame 2 on which the bed sheet 4 is placed is locked with the first connecting arm 10, so that the folding bed 100 is more stable when expanded, thereby improving user experience and durability of the folding bed 100.

In some embodiments, the number of springs 303 is two, and the connection locking mechanism 30 further includes a connecting plate 304 mounted on the first connecting arm 10, the connecting plate 304 is located between the two pressing pieces 301, and each of the springs 303 is positioned between each of the two pressing pieces 301 and the connecting plate 304, so that the two pressing pieces 301 are slidable toward or away from each other under a pressing force or an elastic force of the springs 303. Based on the above design, the springs 303 between the two pressing pieces 301 and the connecting plate 304 are compressed and the hooks 302 of the two pressing pieces 301 moves toward each other when the two pressing pieces 301 located on both sides of the second connecting arm 20 are pressed by the user.

Figure 2:
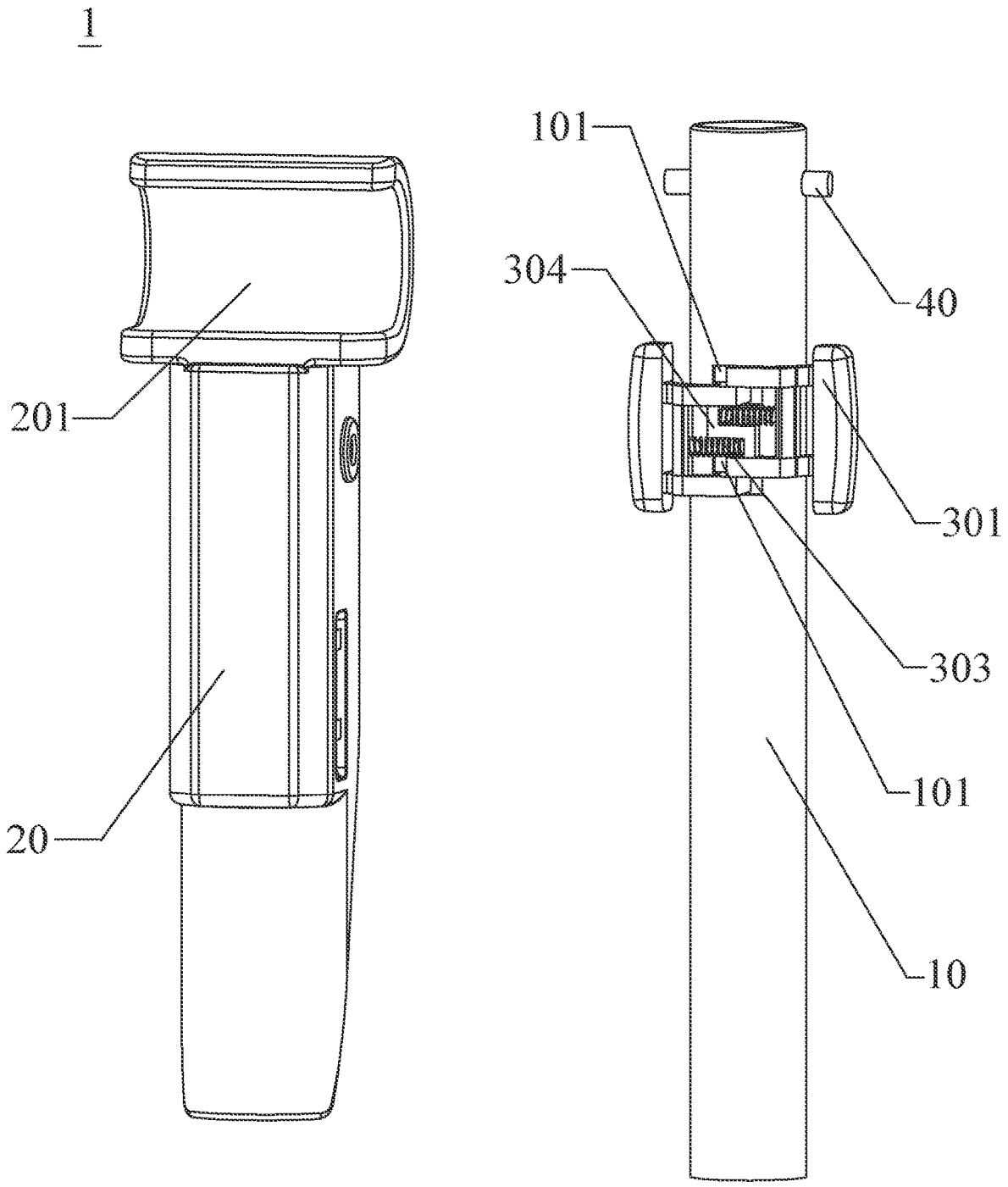
FIG. 2 is an exploded view of the joint device of a folding bed according to an embodiment of the present disclosure.
Figure 3:
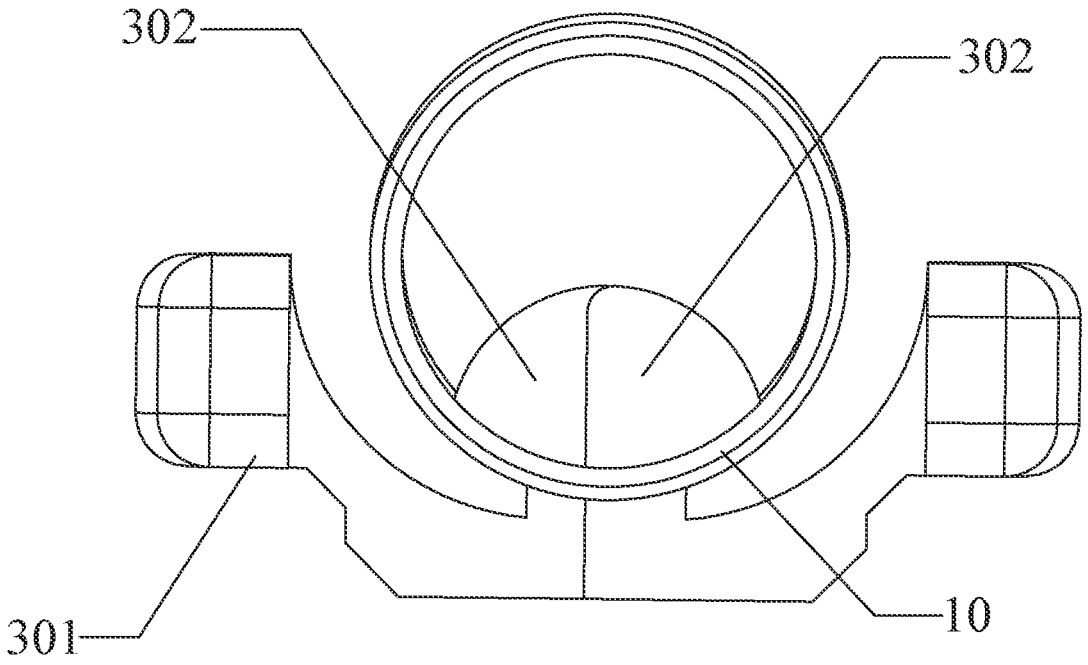
FIG. 3 is a top view of the joint device of a folding bed shown in FIG. 1 with a second connecting arm being removed.
Figure 4:
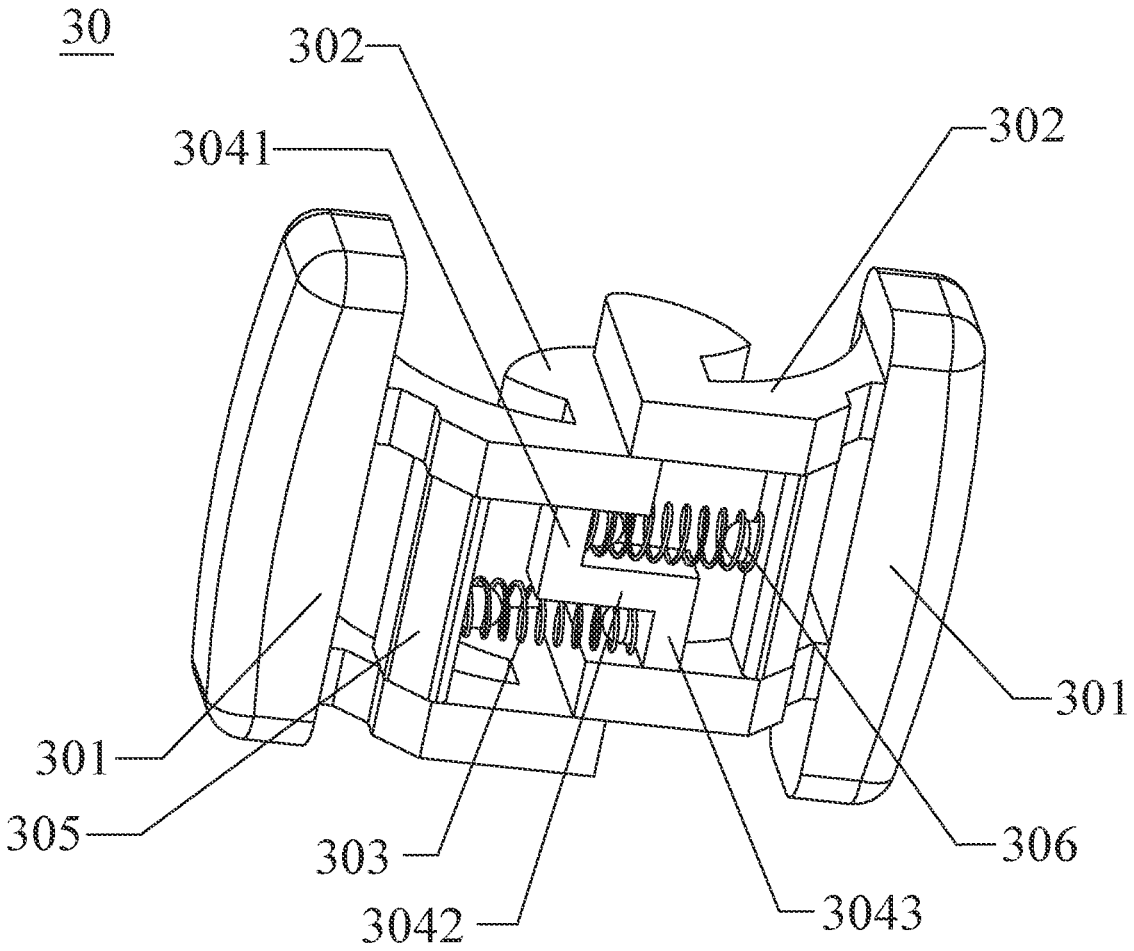
FIG. 4 is a structural view of a connection locking mechanism of the joint device of a folding bed shown in FIG. 1.

Referring to FIGS. 2 to 4, in the present embodiment specifically, each of the two pressing pieces 301 is connected with two hooks 302, the two hooks 302 are arranged side by side in an up-down direction and are located in the through-hole, each of the two hooks 302 on one of the two pressing pieces 301 and each of the two hooks 302 on the other one of the two pressing pieces 301 is alternatively positioned next to each other and overlapping each other. Furthermore, the first connecting arm 10 is provided with two through-holes 101 arranged along the up-down direction, and each pair of the hooks 302 arranged side by side on each of the two pressing pieces are respectively located in the through-holes 101. Therefore, in this embodiment, the hooks 302 on an upper part of the two pressing members 301 are partially overlapped and located in one of the through-holes 101, and the hooks 302 on a lower part of the two pressing members 301 are both located in the other one of the through-holes 101.

Preferably, each of the pressing pieces 301 is provided with an abutting plate 305, the abutting plate 305 is connected to the two hooks 302 of each of the pressing pieces 301, and two ends of the springs 303 being respectively abutted on the abutting plate 305 and the connecting plate. In the present embodiment, the connecting plate 304 includes a first vertical plate 3041, a horizontal plate 3042 bent and extended outward from one end of the first vertical plate 3041, and a second vertical plate 3043 bent and extended downward from the horizontal plate 3042, two ends of one of the springs 303 being respectively abutted against the abutting plate 305 of one of the pressing pieces 301 and the second vertical plate 3043, and two ends of the other one of the springs 303 being respectively abutted against the abutting plate 305 of the other one of the pressing pieces 301 and the first vertical plate 3041. Preferably, the abutting plate 305, the first vertical plate 3041 and the second vertical plate 3043 are each provided with a connecting column 306 for mounting and positioning the spring 303.

Figure 5:
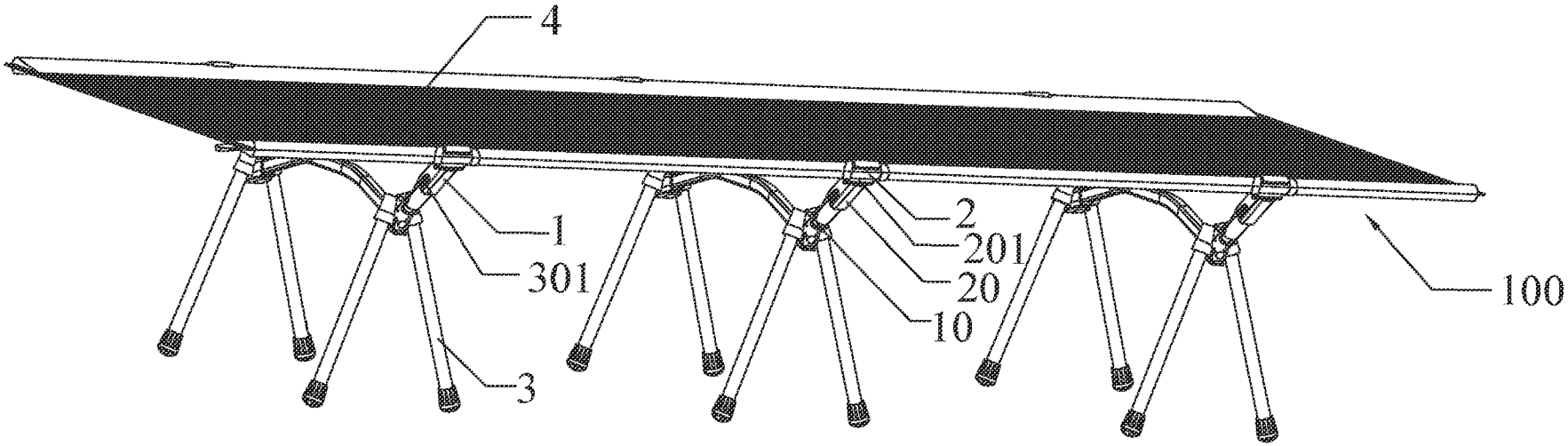
FIG. 5 is a schematic diagram of the joint device of a folding bed of the present disclosure in use.

FIG. 5 is a schematic diagram of the joint device of a folding bed 1 of the present disclosure in use. Combining FIGS. 3 and 4, when applying the joint device of a folding bed 1 in the folding bed 100, one end of the second connecting arm 20 on which the arc-shaped groove 201 is provided is clamped on the frame 2 of the folding bed 100, and is rotatable around the frame 2. The first connecting arm 10 is connected to the legs of the folding bed 100. When the folding bed 100 is expanded, the second connecting arm 20 is locked on the first connecting arm 10 to ensure the stability. Specifically, the two pressing pieces 301 is pressed in order to force the hooks 302 to move toward each other. The overlapping area between the hooks 302 gradually increases, and the hooks 302 are pressed into the through-hole 101 as the width of the hooks 302 after overlapping is smaller than a diameter of the through-hole 101. The pressing pieces 301 are then released, so that the hooks 302 moves relatively to each other under the elastic force of the springs 303, and are hooked in the through-hole 101, so as to lock the second connecting arm 20 that is connected to the frame 2 with the first connecting arm 10, therefore, the folding bed 100 is more stable when expanded. When the folding bed 100 is stored, the second connecting arm 20 and the first connecting arm 10 are unlocked. Specifically, the two pressing pieces 301 are pressed in order to compress the springs 303, such that the hooks 302 move toward each other. The overlapping area between the hooks 302 gradually increases, and the hooks 302 are pulled out of the through-hole 101 as the width of the hooks 302 after overlapping is smaller than the diameter of the through-hole 101. The second connecting arm 20 and the first connecting arm 10 are unlocked, so that the second connecting arm 20 is rotatable around the first connecting arm 10 in order to store the folding bed 100, which improves the user experience and the durability of the folding bed 100.

The above are merely examples of the present disclosure, but are not intended to limit the scope of the present disclosure. Various equivalent changes or substitutions may be made within the technical scope disclosed in the present disclosure by those skilled in the art, and these changes or substitutions shall fall within the scope of protection of the present disclosure.

What is claimed is:

1. A joint device of a folding bed, comprising:

a first connecting arm for connecting a supporting leg of a folding bed, a through-hole being provided on the first connecting arm;

a second connecting arm for connecting a frame of the folding bed, the second connecting arm being arranged on an upper end part of the first connecting arm, and being connected with the first connecting arm through a rotating shaft; and a connection locking mechanism comprising two pressing pieces arranged respectively on each side of the second connecting arm, each of the pressing pieces being connected with a hook, and the two pressing pieces being slidable toward or away from each other through springs, so that the hook passes through the second connecting arm and is hooked into or detached from the through-hole, the second connecting arm being locked with the first connecting arm when the folding bed is expanded, and the second connecting arm being rotatable around the first connecting arm when the folding bed is stored.

2. The joint device of a folding bed according to claim 1, wherein the number of the springs is two, and the connection locking mechanism further comprises a connecting plate mounted on the first connecting arm, the connecting plate is located between the two pressing pieces, and each of the springs is respectively positioned between each one of the two pressing pieces and the connecting plate, so that the two pressing pieces are slidable toward or away from each other under a pressing force or an elastic force of the springs.

3. The joint device of a folding bed according to claim 2, wherein the each one of the two pressing pieces is connected with two hooks, the two hooks are arranged side by side in an up-down direction and located in the through-hole, each of the two hooks on one of the two pressing pieces and each of the two hooks on the other one of the two pressing pieces are alternatively arranged next to each other and overlap each other.

4. The joint device of a folding bed according to claim 3, wherein the each one of the pressing pieces is provided with an abutting plate, the abutting plate is connected between the two hooks of the each one of the two pressing pieces, and two ends of the springs are respectively abutted on the abutting plate and the connecting plate.

5. The joint device of a folding bed according to claim 3, wherein the first connecting arm is provided with two through-holes, the through-holes are arranged along the up-down direction, and the two hooks arranged along the up-down direction on the each one of the two pressing pieces are respectively located in one of the through-holes.

6. The joint device of a folding bed according to claim 2, wherein the connecting plate comprises a first vertical plate, a horizontal plate bent and extended outward from one end of the first vertical plate, and a second vertical plate bent and extended downward from the horizontal plate, two ends of one of the springs are respectively abutted against one of the pressing pieces and the second vertical plate, and two ends of the other one of the springs are respectively abutted against the other one of the pressing pieces and the first vertical plate.

7. The joint device of a folding bed according to claim 1, wherein one end of the second connecting arm is provided with an arc-shaped groove matching the frame of the folding bed, so as to be clamped to the frame of the folding bed and be rotatable around the frame.

* * * * *